US009553359B2

(12) United States Patent
Kagaya

(10) Patent No.: US 9,553,359 B2
(45) Date of Patent: Jan. 24, 2017

(54) ANTENNA APPARATUS

(71) Applicant: ASAHI GLASS COMPANY, LIMITED, Tokyo (JP)

(72) Inventor: Osamu Kagaya, Tokyo (JP)

(73) Assignee: ASAHI GLASS COMPANY, LIMITED, Tokyo (JP)

( * ) Notice: Subject to any disclaimer, the term of this patent is extended or adjusted under 35 U.S.C. 154(b) by 454 days.

(21) Appl. No.: 13/929,659

(22) Filed: Jun. 27, 2013

(65) Prior Publication Data

US 2013/0285861 A1 Oct. 31, 2013

Related U.S. Application Data

(63) Continuation of application No. PCT/JP2011/079930, filed on Dec. 22, 2011.

(30) Foreign Application Priority Data

Dec. 28, 2010 (JP) ..... 2010-293249

(51) Int. Cl.
*H01Q 1/32* (2006.01)
*H01Q 1/12* (2006.01)
(Continued)

(52) U.S. Cl.
CPC ..... *H01Q 1/3291* (2013.01); *H01Q 1/1271* (2013.01); *H01Q 1/1285* (2013.01); *H01Q 13/16* (2013.01); *H01Q 13/18* (2013.01)

(58) Field of Classification Search
CPC ..... H01Q 1/3291; H01Q 1/1271
(Continued)

(56) References Cited

U.S. PATENT DOCUMENTS 5,012,255 A * 4/1991 Becker ..... H01Q 1/1278 343/704
5,124,714 A 6/1992 Harada
(Continued)

FOREIGN PATENT DOCUMENTS

EP 0 561 272 A1 9/1993
EP 0 961 342 A2 12/1999
(Continued)

OTHER PUBLICATIONS

International Search Report PCT/JP2011/079930 dated Apr. 3, 2012.

*Primary Examiner* — Dameon E Levi
*Assistant Examiner* — Walter Davis
(74) *Attorney, Agent, or Firm* — Foley & Lardner LLP

(57) ABSTRACT

An antenna apparatus includes a glass plate that is fixed to a flange of a vehicle body at a window opening portion of the vehicle body; a dielectric material; a conductive film provided between the glass plate and the dielectric material; and a monopolar feeding portion provided on the dielectric material at a surface opposite to a glass plate side and at a position capable of being capacitively coupled to the conductive film, the antenna apparatus being configured such that a clearance between an end portion of the flange of the vehicle body and an outer edge of the conductive film functions as a slot antenna, the conductive film being provided with a notch having one end as an open end at the outer edge of the conductive film in the vicinity of the feeding portion.

8 Claims, 9 Drawing Sheets

(51) Int. Cl.
*H01Q 13/16* (2006.01)
*H01Q 13/18* (2006.01)

(58) Field of Classification Search
USPC ..... 343/712, 711, 704
See application file for complete search history.

(56) References Cited

U.S. PATENT DOCUMENTS

| | | | | |
|---|---|---|---|---|
| 5,355,144 | A | 10/1994 | Walton et al. | |
| 5,831,580 | A | 11/1998 | Taniguchi et al. | |
| 5,898,407 | A * | 4/1999 | Paulus | B32B 17/10 343/713 |
| 6,320,276 | B1 | 11/2001 | Sauer | |
| 7,190,316 | B2 * | 3/2007 | Yegin | H01Q 1/1285 343/700 MS |
| 2004/0070540 | A1 | 4/2004 | Wang et al. | |
| 2005/0190112 | A1 | 9/2005 | Thudor et al. | |
| 2006/0017632 | A1 | 1/2006 | Funatsu | |
| 2006/0202898 | A1 | 9/2006 | Li et al. | |
| 2012/0154229 | A1 * | 6/2012 | Kagaya | H01Q 13/10 343/713 |

FOREIGN PATENT DOCUMENTS

| | | | |
|---|---|---|---|
| EP | 1 580 839 | A1 | 9/2005 |
| JP | 6-45817 | A | 2/1994 |
| JP | H07-235821 | A | 9/1995 |
| JP | 9-175166 | | 7/1997 |
| JP | H11-163625 | A | 6/1999 |
| JP | 2000-59123 | | 2/2000 |
| JP | 2005-012587 | | 1/2005 |
| JP | 2005-278159 | A | 10/2005 |
| JP | 2006-525691 | A | 11/2006 |
| JP | 2010-263646 | A | 11/2010 |

* cited by examiner

ANTENNA APPARATUS

CROSS-REFERENCE TO RELATED APPLICATION

This application is a continuation application filed under 35 U.S.C. 111(a) claiming the benefit under 35 U.S.C. 120 and 365(c) of PCT International Application No. PCT/JP2011/079930 filed on Dec. 22, 2011, which is based upon and claims the benefit of priority of Japanese Priority Application No. 2010-293249 filed on Dec. 28, 2010, the entire contents of which are hereby incorporated by reference.

BACKGROUND OF THE INVENTION

1. Field of the Invention

The present invention relates to an antenna apparatus using a clearance between an end portion of a flange of a vehicle body that forms a window opening portion of the vehicle body and a conductive film.

2. Description of the Related Art

FIG. 1 is a cross-sectional view of a vehicle laminated glass including glass plates 1 and 2, and a conductive film 3 and an intermediate film 4, sandwiched by the glass plates 1 and 2. The conductive film 3 is a protection film which suppresses transition of heat waves such as sunlight or the like. When the laminated glass is provided with an antenna conductor 5 for receiving radio waves at a vehicle interior side, there are cases where required reception characteristics cannot be sufficiently obtained as the radio waves coming from the outside of the vehicle are shielded by the conductive film 3.

To remove such a disadvantage, a window glass is known in which an antenna function is provided by using a conductive film (see, for example, Patent Documents 1, 2 and 3).

PATENT DOCUMENT

[Patent Document 1] Japanese Laid-open Patent Publication No. H6-45817

[Patent Document 2] Japanese Laid-open Patent Publication No. H9-175166

[Patent Document 3] Japanese Laid-open Patent Publication No. 2000-59123

Generally, a window glass is fixed to a flange of a vehicle body that forms a window opening portion of the vehicle body. Patent Documents 1 and 2 disclose a slot antenna using a clearance between an end portion of the flange of the vehicle body and an outer edge of the conductive film. The size of the window opening portion is different in accordance with the kinds of the vehicles. Thus, the perimeter of the clearance between the end portion of the flange of the vehicle body and the outer edge of the conductive film surrounding the conductive film is different in accordance with the kinds of the vehicles. Thus, in a conventional slot antenna, it is necessary to finely adjust the perimeter of the clearance by adjusting the size of the conductive film in order to match the antenna. However, it is a troublesome operation to match the antenna by adjusting the size of the conductive film, which requires a large amount of time and cost.

Further, in the conventional slot antenna, if it is necessary to expand the width (space) of the clearance between the end portion of the flange of the vehicle body and the outer edge of the conductive film in order to obtain a desired antenna gain, the size of the conductive film is reduced. At this time, an area in which the transmission of heat waves such as sunlight or the like cannot be suppressed is increased with respect to the decreasing of the area of conductive film so that the function of the conductive film to suppress the heat waves is decreased.

SUMMARY OF THE INVENTION

The present invention is made in light of the above problems, and provides an antenna apparatus capable of being matched without changing a width of a clearance between an end portion of a flange of the vehicle body and an outer edge of a conductive film as well as capable of improving radiation efficiency and antenna gain.

According to an embodiment, there is provided an antenna apparatus including a glass plate that is fixed to a flange of a vehicle body at a window opening portion of the vehicle body; a dielectric material; a conductive film provided between the glass plate and the dielectric material; and a monopolar feeding portion provided on the dielectric material at a surface opposite to a glass plate side and at a position capable of being capacitively coupled to the conductive film, the antenna apparatus being configured such that a clearance between an end portion of the flange of the vehicle body and an outer edge of the conductive film functions as a slot antenna, the conductive film being provided with a notch having one end as an open end at the outer edge of the conductive film in the vicinity of the feeding portion.

According to the embodiment, the antenna can be matched without changing the width of the clearance between the end portion of the flange of the vehicle body and the outer edge of the conductive film, so that radiation efficiency and antenna gain can be improved.

Note that also arbitrary combinations of the above-described elements, and any changes of expressions in the present invention, made among methods, devices, systems and so forth, are valid as embodiments of the present invention.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

Figure 1:
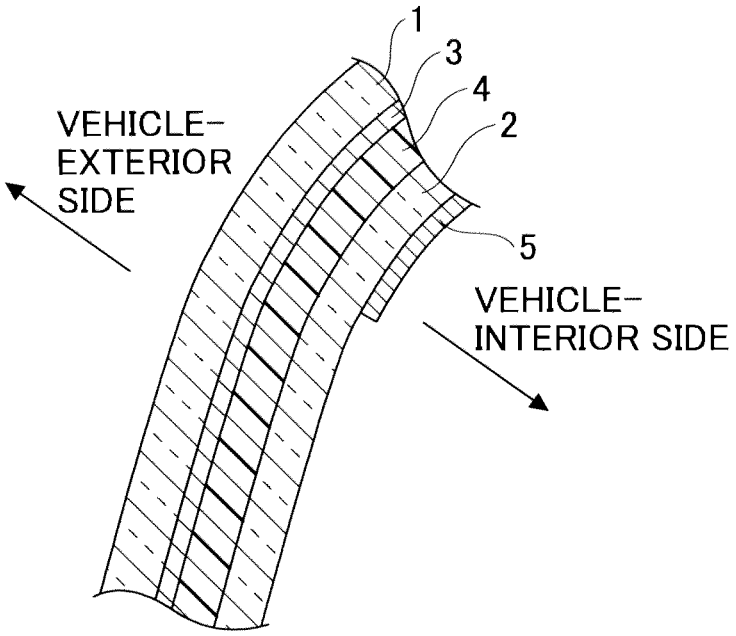
FIG. 1 is a cross-sectional view of a vehicle laminated glass including glass plates 1 and 2, and a conductive film 3 and an intermediate film 4, sandwiched by the glass plates 1 and 2.

The invention will be described herein with reference to illustrative embodiments. In the drawings for explaining the embodiments, a direction shows a direction in the drawings unless otherwise explained and a reference direction in each of the drawings corresponds to a direction of marks or numerals. Further, a direction in parallel, a direction in perpendicular and the like may include a distortion as long as it does not influence an advantage of the present invention. Further, the present invention may be applicable for a front glass attached to a front portion of a vehicle, a rear glass attached to a rear portion of a vehicle, and a side glass attached to a side portion of a vehicle.

Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

Figure 2:
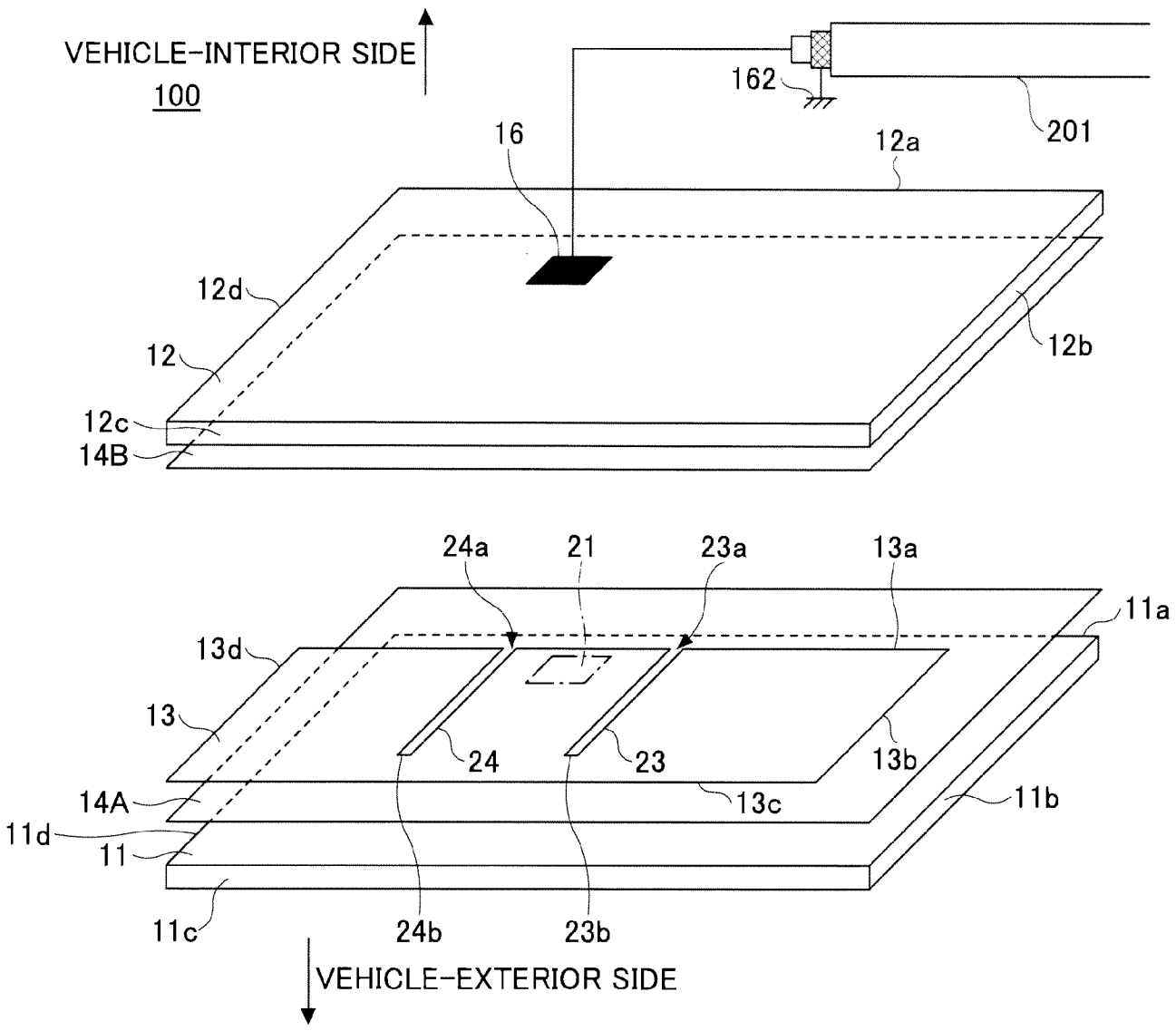
FIG. 2 is an exploded view of a vehicle window glass 100 of a first embodiment.

FIG. 2 is an exploded view of a vehicle window glass 100 composing an antenna apparatus of the embodiment. The vehicle window glass 100 is a laminated glass formed by laminating a glass plate 11, which is an example of a first glass plate, provided at a vehicle exterior side and a glass plate 12, which is an example of a second glass plate, provided at a vehicle interior side. FIG. 2 shows elements of the vehicle window glass 100 separated in a direction of a normal line with respect to a surface of the glass plate 11 (or the glass plate 12).

The vehicle window glass 100 includes the glass plate 11, the glass plate 12, an electrode (feeding portion) 16 and a conductive film 13. Here, the glass plate 12 is used for a dielectric material which sandwiches the conductive film 13 with the glass plate 11. The glass plate 11 and the glass plate 12 have substantially the same size and outer peripheral ends (11*a* to 11*d*) of the glass plate 11 and outer peripheral ends (12*a* to 12*d*) of the glass plate 12 have the same shape, respectively, when seen from a direction (which will be referred to as a "stacked direction" hereinafter) in which the glass plate 12, the conductive film 13 and the glass plate 11 are stacked.

The electrode 16 is a monopolar feeding portion provided at a surface of the glass plate 12 opposite to a surface at a glass plate 11 side. The monopolar means that only a single feeding portion is provided and no grounded feeding portion is provided. The conductive film 13 is provided between the glass plate 11 and the glass plate 12 so as to overlap a projection of the electrode 16 onto the glass plate 11 side. With this configuration, the electrode 16 capacitively couples with a projected area 21 in the conductive film 13 via the glass plate 12. The conductive film 13 is provided with notches, each having an open end at an outer edge 13*a* of the conductive film 13 in the vicinity of the projected area 21 of the electrode 16. FIG. 2 shows a notch 23 provided with an open end 23*a* and a notch 24 provided with an open end 24*a*.

Figure 3:
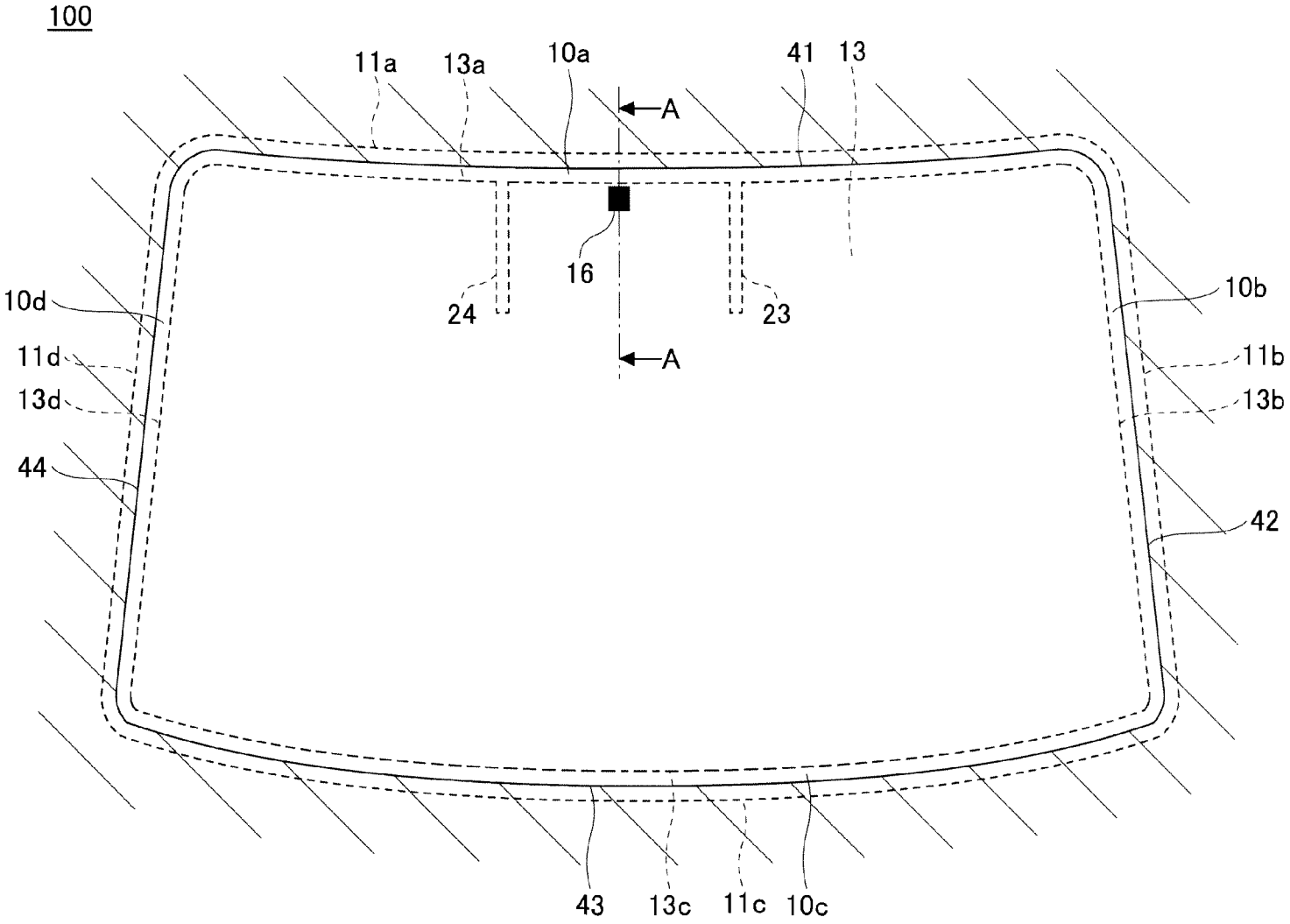
FIG. 3 is an elevation view (seen from a vehicle interior side) illustrating a status in which the vehicle window glass 100 is attached to a flange of a window glass attaching portion at a vehicle body side.

FIG. 3 is an elevation view (seen from the vehicle interior side) illustrating an antenna apparatus which is configured by attaching the vehicle window glass 100 to a window opening portion of a vehicle body. The conductive film 13 is provided such that outer edges 13*a* to 13*d* of the conductive film 13 are positioned inside and spaced away with respect to the outer peripheral edges 11*a* to 11*d* of the glass plate 11 for a predetermined distance, respectively. By providing such a space, corrosion of the conductive film 13 by water immersion or the like from a mating surface of the glass plates 11 and 12 can be prevented. The antenna apparatus is a so-called slot antenna. The clearances 10*a* to 10*d* having a loop shape formed between the end portions 41 to 44 of the flange of the vehicle body, which forms the window opening portion to which the glass plate 12 or the glass plate 11 is attached, and the outer edges 13*a* to 13*d* of the conductive film 13, function as the slot antenna.

With this structure, while making the electrode 16 as a feeding point, the current flowing along the clearances 10*a* to 10*d* can be varied by adjusting the positions or the lengths of the notches 23 and 24. Thus, the slot antenna can be easily matched by adjusting embodiments (for example, sizes, shapes or the like) of the notches 23 and 24 formed in the conductive film 13 without varying the gap lengths of the clearances 10*a* to 10*d*, which are the widths between the end portions 41 to 44 of the flange of the vehicle body and the outer edges 13*a* to 13*d* of the conductive film, respectively. Then, as it is unnecessary to change the gap lengths of the clearances 10*a* to 10*d* for matching, the slot antenna can be easily matched while the area of the conductive film 13 for suppressing transmission of heat waves such as sunlight or the like is retained to be larger. Further, compared with a case when the notch is not formed at the conductive film 13, the current that flows along the outer edge 13*a* of the conductive film 13 can be suppressed by the notches 23 and 24 so that the radiation efficiency as the slot antenna can be increased and the antenna gain is easily improved.

The present embodiment is further explained in detail. The vehicle window glass 100 shown in FIG. 2 has a stacked structure in which the conductive film 13 is provided between the glass plate 11 and the glass plate 12 in a layered manner.

There is provided an intermediate film 14A between the glass plate 11 and the conductive film 13. There is provided an intermediate film 14B between the conductive film 13 and the glass plate 12. The glass plate 11 and the conductive film 13 are bonded by the intermediate film 14A, and the conductive film 13 and the glass plate 12 are bonded by the intermediate film 14B. The intermediate films 14A and 14B are, for example, thermo plastic polyvinyl butyral. The relative dielectric constant $\in r$ of the intermediate films 14A and 14B may be more than or equal to 2.8 and less than or equal to 3.0, which is a general relative dielectric constant of an intermediate film of a laminated glass.

The glass plates 11 and 12 are transparent dielectric plates, respectively. Further, alternatively, one of the glass plates 11 and 12 may be translucent, or both of the glass plates 11 and 12 may be translucent.

Figure 5A:
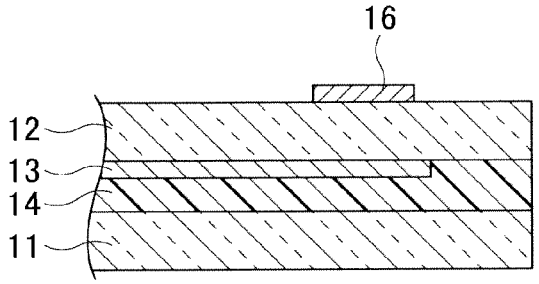
FIG. 5A is a view illustrating an embodiment where a conductive film 13 is coated on a glass plate 12.
Figure 5B:
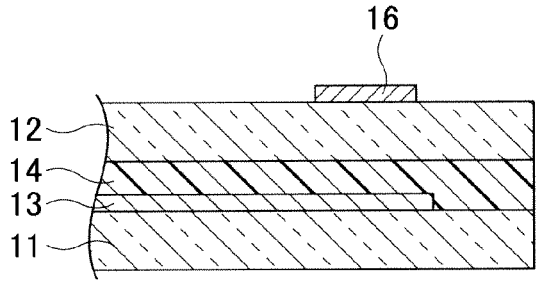
FIG. 5B is a view illustrating an embodiment where a conductive film 13 is coated on a glass plate 11.
Figure 5C:
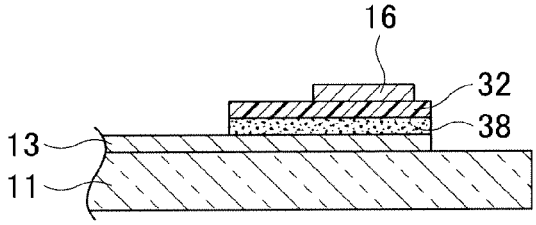
FIG. 5C is a view illustrating an embodiment where a conductive film 13 between the glass plate 11 and a dielectric material substrate 32 is coated on the glass plate 11.
Figure 5D:
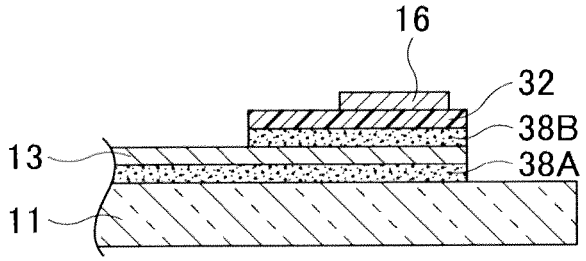
FIG. 5D is a view illustrating an embodiment where a conductive film 13 between the glass plate 11 and the dielectric material substrate 32 is adhered to the plate 11 by an adhesive agent 38A.

The conductive film 13 is a conductive heat wave reflection film capable of reflecting heat waves coming from the outside. The conductive film 13 is transparent or translucent. The conductive film 13 may be a conductive film formed on a surface of a polyethylene terephthalate film, for example, or a conductive film formed on a surface of the glass plate (11 or 12) as shown in FIG. 5A to 5C. Further, as shown in FIG. 5D, the conductive film 13 may be adhered to a surface of the glass plate 11 by an adhesive agent 38A. As shown in FIGS. 2 and 3, the conductive film 13 is provided with the notch 23 having the open end 23*a* at the outer edge 13*a* of the conductive film 13 and the notch 24 having the open end 24*a* at the outer edge 13*a*, which is the same end as that of the open end 23*a* of the notch 23.

As shown in FIG. 2 and FIG. 3, the notch 23 is formed from the outer edge 13*a* of the conductive film 13 toward inside. The outer edge 13*a* is one of outer edges of the conductive film 13. The notch 23 is formed by removing the conductive film 13 from the open end 23*a* to a front end portion 23*b* in a line shape. Similar to the notch 23, the notch 24 is formed by removing the conductive film 13 from the open end 24*a* to a front end portion 24*b* in a line shape. The front end portions 23*b* and 24*b* are end portions not opened at the outer edges (13*a* to 13*d*) of the conductive film 13.

As shown in FIG. 2, the electrode 16 is positioned at an opposite side to the position of the conductive film 13 while interposing the glass plate 12 therebetween. The electrode 16 is positioned at a surface of the glass plate 12 at the vehicle interior side (in other words, a surface of the glass plate 12 opposite to a surface facing the conductive film 13) in an exposed manner such that the projected area 21 of the electrode 16, projected on the conductive film 13 from the stacked direction of the glass plates or the like, is positioned inside the outer edge 13*a* of the conductive film 13.

Here, the projected area 21 of the electrode 16 may be positioned in an area between the outer edge 13*a* of the conductive film on which the open ends 23*a* and 24*a* are provided and an interface line which is parallel to the outer edge 13*a* and passes the front end portions 23*b* and 24*b* opposite to the open ends 23*a* and 24*a*, respectively. In other words, when the projected area 21 of the electrode 16 is positioned at a side of the open ends 23*a* and 24*a* rather than that of the front end portions 23*b* and 24*b* of the notches 23 and 24, respectively, there is an advantage in that the antenna can be easily matched. Further, in a view point of easily adjusting the matching of the antenna, the number of notches formed in the vicinity of the electrode 16 is not limited to two, but may be one or three or more. By providing a plurality of the notches in the vicinity of the electrode 16, the radiation efficiency of the antenna can be improved in addition to making it easy to adjust matching. Specifically, as shown in the drawings, the electrode 16 may be provided between the two notches.

The embodiments (shapes, sizes or the like) of the electrode 16 and the notches 23 and 24 may be determined to satisfy a required value of antenna gain necessary for receiving radio waves that the antenna is to receive. For example, when the frequency band that the antenna is to receive is digital terrestrial television broadcasting band 470 to 710 MHz, the electrode 16 and the notches 23 and 24 are formed to be adaptable for receiving radio waves of the digital terrestrial television broadcasting band 470 to 710 MHz.

When it is assumed that the wavelength in the air at the center frequency of a predetermined frequency band received by the present antenna apparatus is $\lambda 0$, the glass shortening coefficient of wavelength is k (here, k=0.64) and $\lambda g=\lambda 0 \cdot k$, the minimum distance between the center of the electrode 16 and the center line of the notch 23 in its width direction may be more than or equal to 0.25 $\lambda g$ and less than or equal to $\lambda g$. With this configuration, a preferable result in improving the antenna gain at the frequency band can be obtained.

For example, in order to improve the antenna gain of the predetermined frequency band whose center frequency is 590 MHz, provided that the speed of the radio wave is $3.0\times10^8$ m/s, the minimum distance between the center of the electrode 16 and the center line of the notch 23 in its width direction may be adjusted to be more than or equal to 81 mm and less than or equal to 330 mm.

Similarly, the length of the notch 23 from the open end 23*a* to the front end may be more than or equal to 0.25 $\lambda g$ and less than or equal to $\lambda g$. With this configuration, a preferable result in improving the antenna gain at the frequency band can be obtained.

For example, in order to improve the antenna gain of the predetermined frequency band whose center frequency is 590 MHz, the length of the notch 23 from the open end 23*a* to the front end may be adjusted to be more than or equal to 81 mm and less than or equal to 330 mm.

Further, positions of the electrode 16 and the notches 23 and 24 on the glass plate are not specifically limited as long as they are adaptable for receiving the radio waves of a frequency band that the antenna is to receive. For example, the antenna of the embodiment may be provided in the vicinity of the flange of the vehicle body to which the vehicle window glass is to be attached. As shown in FIG. 3, it is preferable that the antenna is positioned in the vicinity of the end portion 41 of the flange of the vehicle body at a roof side when considering easiness in matching and improvement of discharging efficiency. Further, the antenna may be provided at a position shifted from the position shown in FIG. 3 rightward or leftward to be closer to the end portion 42 or 44 of the flange of the vehicle body at a pillar side, respectively. Further, the antenna may be provided in the vicinity of the end portion 43 of the flange of the vehicle body at a chassis side.

For a case shown in FIG. 3, longitudinal directions of the notches 23 and 24 match a direction perpendicular to a side of the end portion 41 or 43 of the flange of the vehicle body. However, the longitudinal directions of the notches 23 and 24 are not necessarily in a perpendicular relationship with the side of the end portion of the flange of the vehicle body (or the outer edge of the conductive film 13). The angles of the longitudinal directions of the notches 23 and 24 with respect to the side may be more than or equal to 5° or less than 90°, respectively.

An attachment angle of the window glass to the vehicle may be 15 to 90°, specifically, 30 to 90° with respect to a horizontal surface (a level surface) when considering easiness in matching and improvement of radiation efficiency.

The electrode 16 is electrically connected to a signal path of an external signal processing apparatus (for example, an on-vehicle amplifier) via a predetermined conductive member 201. As the conductive member 201, for example, a feeding line such as an AV line, a coaxial cable or the like is used. When the AV line is used, the AV line is electrically connected to the electrode 16. When the coaxial cable is used, an inner conductor of the coaxial cable may be electrically connected to the electrode 16 while an outer conductor of the coaxial cable may be grounded to the vehicle body. Further, a structure in which a connector for electrically connecting a conductive member such as a conductor or the like connected to the signal processing apparatus to the electrode 16 is mounted on the electrode 16 may be adopted. The AV line or the inner conductor of the coaxial cable can be easily attached to the electrode 16 by such a connector. Further, a protruding conductive member may be provided on the electrode 16 such that the protruding conductive member contacts and engages a flange 45 of the vehicle body to which the vehicle window glass 100 is attached.

The shape of the electrode 16 may be determined based on the shape or the like of a mounting surface of the above described conductive member or the connector. For example, the electrode 16 may have a rectangular shape such as foursquare, substantially square, rectangular, substantially rectangular or the like, or a polygonal shape when considering an implementation. The electrode 16 may have a circular shape such as circle, substantially circle, ellipse, substantially ellipse or the like.

The electrode 16 is formed by printing a paste including a conducting metal such as a silver paste or the like on a surface of the glass plate 12 at the vehicle interior side and baking. However, the method of forming the electrode 16 is not limited so. Alternatively, the electrode 16 may be formed by forming a linear portion or film of a conductive material such as copper or the like on the surface of the glass plate 12 at the vehicle interior side, or adhering by an adhesive agent to the glass plate 12.

Further, a masking film formed at a surface of the glass plate may be provided between the electrode 16 and the glass plate 11 (at a deeper side in FIG. 3) in order to have the electrode 16 not seen from the vehicle exterior side. For the masking film, ceramics, which is a baked material, such as a black ceramics film or the like may be used. At this time, the electrode 16 which is formed on the masking film cannot be recognized from the vehicle exterior side of the window glass because of the masking film so that the good design of the window glass can be obtained.

Figure 4:
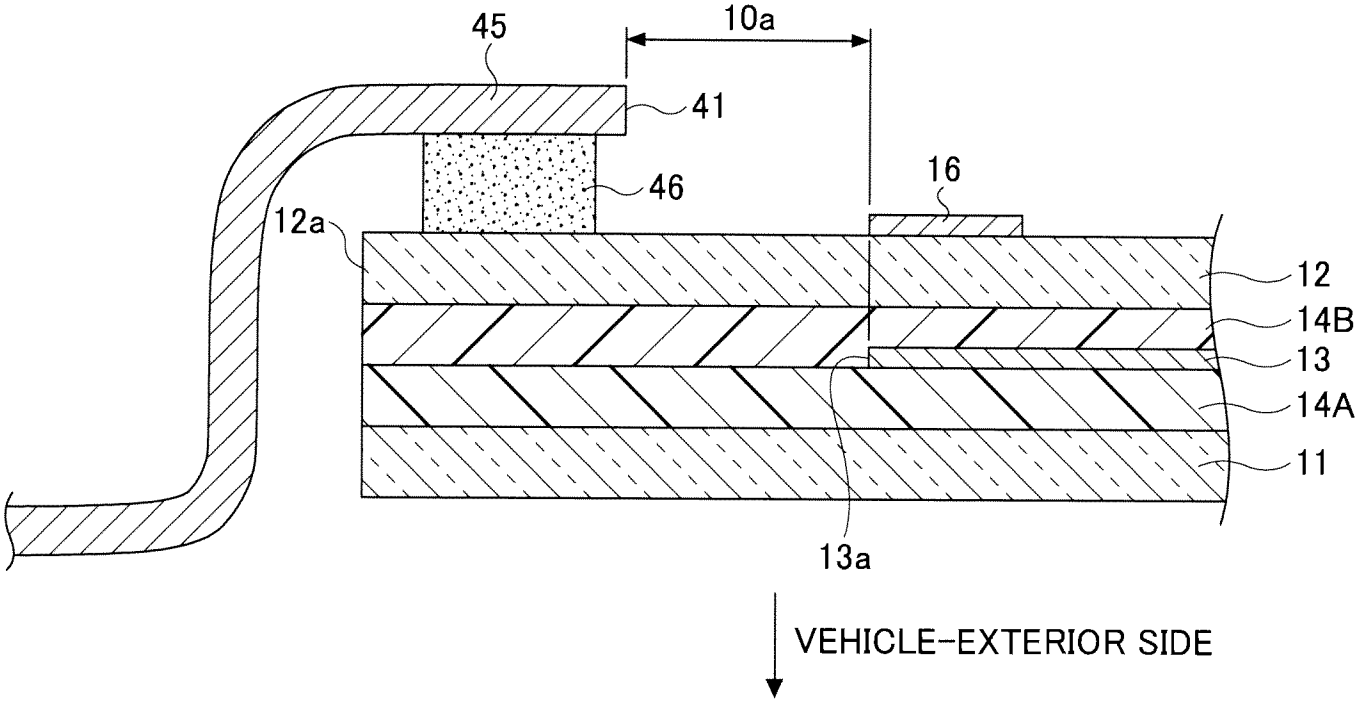
FIG. 4 is a cross-sectional view of the vehicle window glass taken along an A-A line in FIG. 3.

FIG. 4 is a cross-sectional view of the vehicle window glass 100 taken along an A-A line in FIG. 3. The flange 45 of the vehicle body is formed for attaching the vehicle window glass 100 thereto by bending inside from the vehicle body toward the window opening portion. The glass plates 11 and 12 composing the laminated glass are fixed to the flange 45 of the vehicle body by bonding the glass plate 12 to the flange 45 of the vehicle body by the adhesive agent 46 (or a gasket).

Figure 6A:
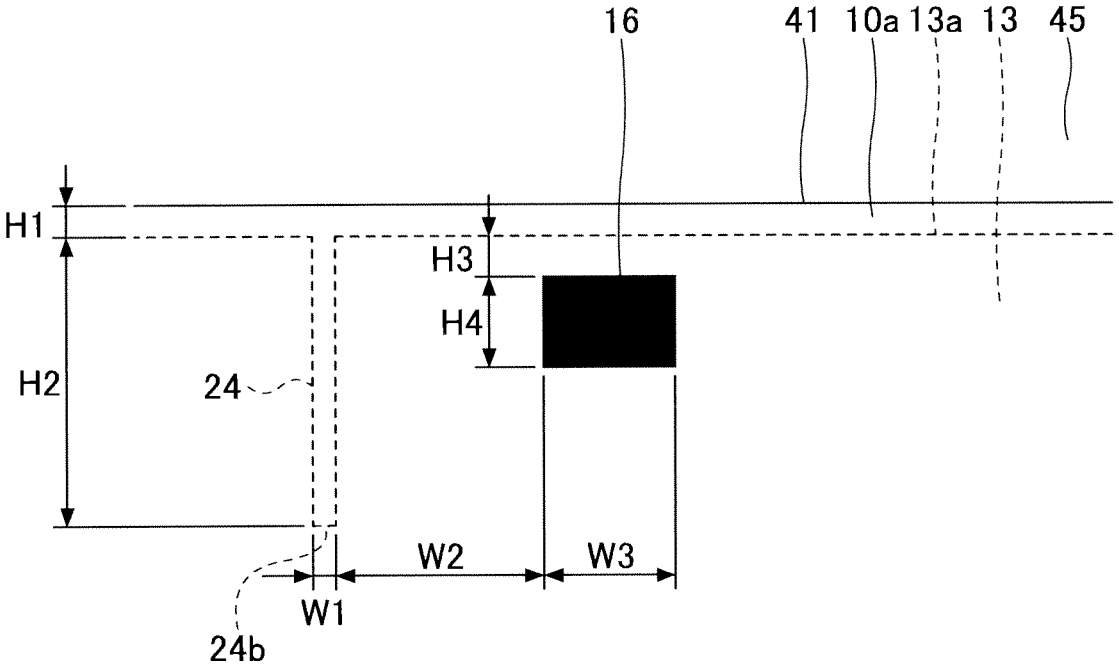
FIG. 6A is an elevation view illustrating an antenna apparatus including only a notch 24.
Figure 6B:
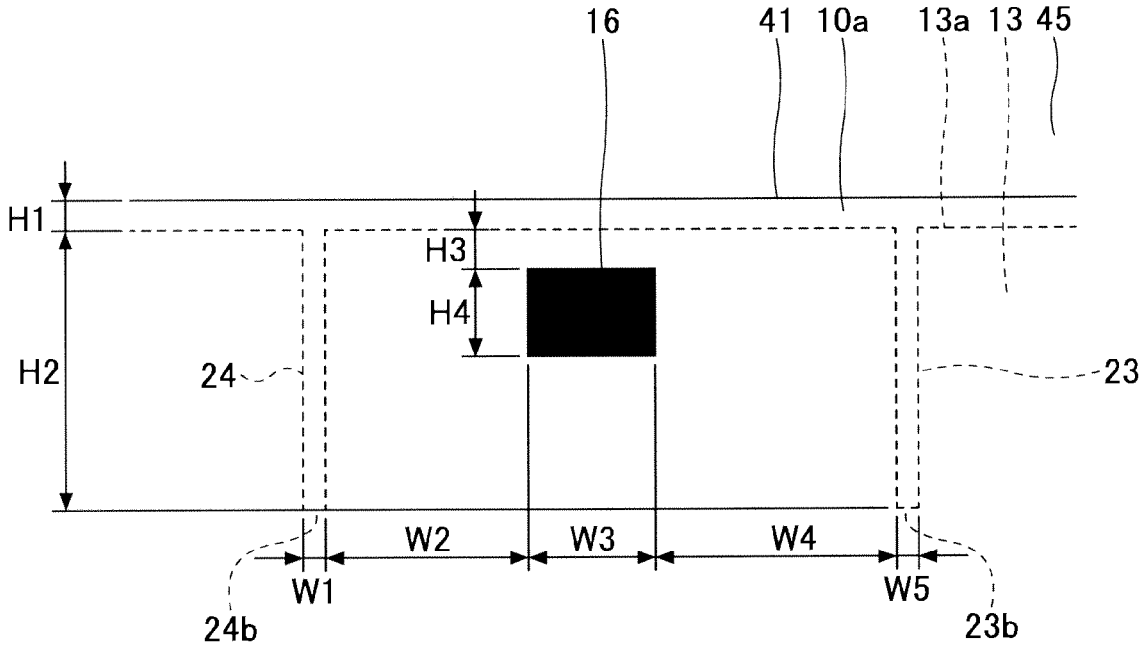
FIG. 6B is an elevation view illustrating an antenna apparatus including notches 23 and 24.

As shown in FIG. 6A and FIG. 6B, the clearance 10*a*, which functions as the slot antenna, is formed between the end portion 41 of the flange 45 of the vehicle body and the outer edge 13*a* of the conductive film 13, which is nearest to the end portion 41. The length of the clearance 10*a* in a direction perpendicular to a direction of a normal line of the conductive film 13 (in other words, the gap length H1 of the clearance 10*a*) may be less than or equal to 20 mm, and more preferably, less than or equal to 15 mm. With this configuration, an advantage that the antenna is easily matched and the radiation efficiency is improved is obtained. When the gap length H1 of the clearance 10*a* exceeds 20 mm, it is difficult to match the antenna. Here, the gap length H1 of the clearance 10*a* may be more than or equal to 1 mm considering precision margin in manufacturing such as attaching the glass plate to the flange of the vehicle body or the like.

FIG. 5A to FIG. 5D show variations of the stacked structure of the vehicle window glass that composes the antenna apparatus of the embodiment. FIG. 5A to FIG. 5D are cross-sectional views of the vehicle window glass taken along the A-A line in FIG. 3. As shown in FIG. 4 and FIG. 5A to FIG. 5D, the conductive film 13 is provided between the glass plate 11 and a dielectric material (in other words, the glass plate 12 or a dielectric material substrate 32). The conductive film 13 is in contact with an adhesion film between the glass plate and the dielectric material.

For the case shown in FIG. 4, FIG. 5A and FIG. 5B, the conductive film 13 and the intermediate film 14 (or the intermediate films 14A and 14B) are provided between the glass plate 11 and the glass plate 12. FIG. 4 shows an embodiment in which the conductive film 13 formed in a film form is sandwiched between the intermediate film 14A that contacts a facing surface of the glass plate 11 facing the glass plate 12 and the intermediate film 14B that contacts a facing surface of the glass plate 11 facing the glass plate 12. The conductive film 13 formed in the film form may be formed by coating the conductive film 13 such as by performing vapor deposition of the conductive film 13 on a film. FIG. 5A shows an embodiment in which the conductive film 13 is coated on the glass plate 12 by performing vapor deposition of the conductive film 13 on the facing surface of the glass plate 12 facing the glass plate 11. FIG. 5R shows an embodiment in which the conductive film 13 is coated on the glass plate 11 by performing vapor deposition of the conductive film 13 on the facing surface of the glass plate 11 facing the glass plate 12.

Further, as shown in FIG. 5C and FIG. 5D, the vehicle window glass of the antenna apparatus of the embodiment may not be the laminated glass. At this time, the dielectric material may not have a size the same as that of the glass plate 11 and may be a dielectric material substrate having a size sufficient for the electrode 16 to be formed thereon. For the cases shown in FIG. 5C and FIG. 5D, the conductive film 13 is provided between the glass plate 11 and the dielectric material substrate 32. FIG. 5C is a view illustrating an embodiment where the conductive film 13 is coated on the glass plate 11 by vapor depositing the conductive film 13 on the facing surface of the glass plate 11 that is facing the dielectric material substrate 32. The conductive film 13 and the dielectric material substrate 32 are bonded with each other by the adhesive agent 38. FIG. 5D is a view illustrating an embodiment where the conductive film 13 is adhered to the facing surface of the glass plate 11 that is facing the dielectric material substrate 32 by the adhesive agent 38A. The conductive film 13 and the dielectric material substrate 32 are bonded by the adhesive agent 38B. The dielectric material substrate 32 is a resin substrate provided with the electrode 16. The dielectric material substrate 32 may be a resin print substrate on which the electrode 16 is printed (for example, a glass epoxy substrate in which a copper foil is attached to FR4).

As can be understood from FIG. 4 and FIG. 5A to FIG. 5D, the electrode 16 is provided at the glass plate 12 or the dielectric material substrate 32 to overlap the conductive film 13 when seen from the stacked direction.

Example 1

As shown in FIG. 4, a window glass, which is a laminated glass obtained by bonding two glass plates 11 and 12, each having a rectangular shape of 800 mm in a vertical direction and 1400 mm in a lateral direction with a thickness of 2.0 mm, via two intermediate films 14A and 14B is assumed. Value calculations are performed on a computer for antenna apparatuses shown in FIG. 6A (a single notch is provided) and FIG. 6B (two notches are provided). An electrode 16 is provided at a surface of the glass plate 12 at a vehicle interior side, which is assumed to be at a vehicle interior side, and a conductive film 13 provided with a notch 23 (and a notch 24) is provided between the two intermediate films 14A and 14B. The conductive film 13 has a rectangular shape of 790 mm in the vertical direction and 1390 mm in the lateral direction. Outer edges of the conductive film 13, all of four, are spaced from outer peripheral ends of the glass plates 11 and 12 for 5 mm, respectively. The electrode 16 is provided such that the center in a left-right direction passes the center of the glass plates in the left-right direction. The flange 45 of the vehicle body is assumed such that infinite conductivities are connected at the end portion 41, and the window glass is assumed to be a front glass so that a defogger is not provided.

In FIGS. 6A and 6B, the size of the parts, other than the above described parts, are as follows where the unit of measure is "mm".

H1: 5
H3: 0
H4: 20
W1: 3
W3: 20
W5: 3

Here, "H1" corresponds to the gap length of the clearance 10*a*. "H3" indicates an interval between the outer edge of the conductive film and an upper end of the electrode. "H4" indicates the length of the electrode in the vertical direction. "W1" indicates the width of the notch. "W2" indicates an interval between a side end portion of the left notch and a left side portion of the electrode. "W3" indicates the width of the electrode in the lateral direction. "W4" indicates an interval between a side end portion of the right notch and a left side portion of the electrode. "W5" indicates the width of the notch.

Further, it is set as follows.

The relative dielectric constant of the glass plate: 7.0

The thickness of each of the intermediate films: 0.38 mm (15 mil)

The sheet resistance of the conductive film 13: 2.0Ω

The thickness of the conductive film 13: 0.01 mm

The thickness of the electrode 16: 0.01 mm

Normalized impedance: 200Ω

For the antenna apparatuses defined above, values of S11 (return-loss (reflection coefficient)) are calculated for every 5 Hz within a frequency range of 25 to 1000 MHz by an electromagnetic field simulation based on Finite-Difference Time-Domain method (FDTD). For S11, as the value is close to zero, it means that the return-loss is large and the antenna gain becomes small and as the minus values becomes large, it means that the return-loss is small and the antenna gain is large.

Figure 7:
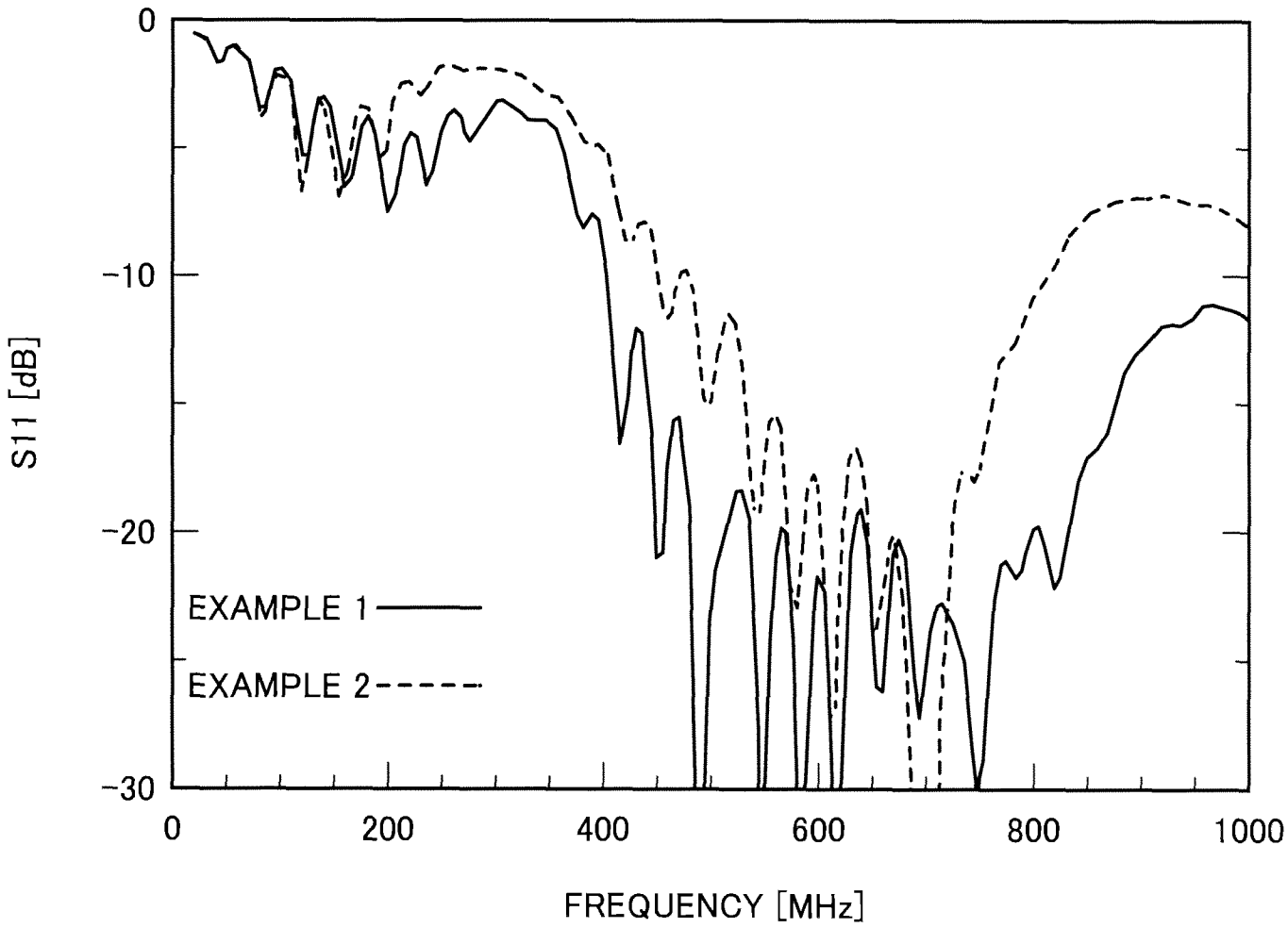
FIG. 7 is a view illustrating simulation results of S11.
Figure 8:
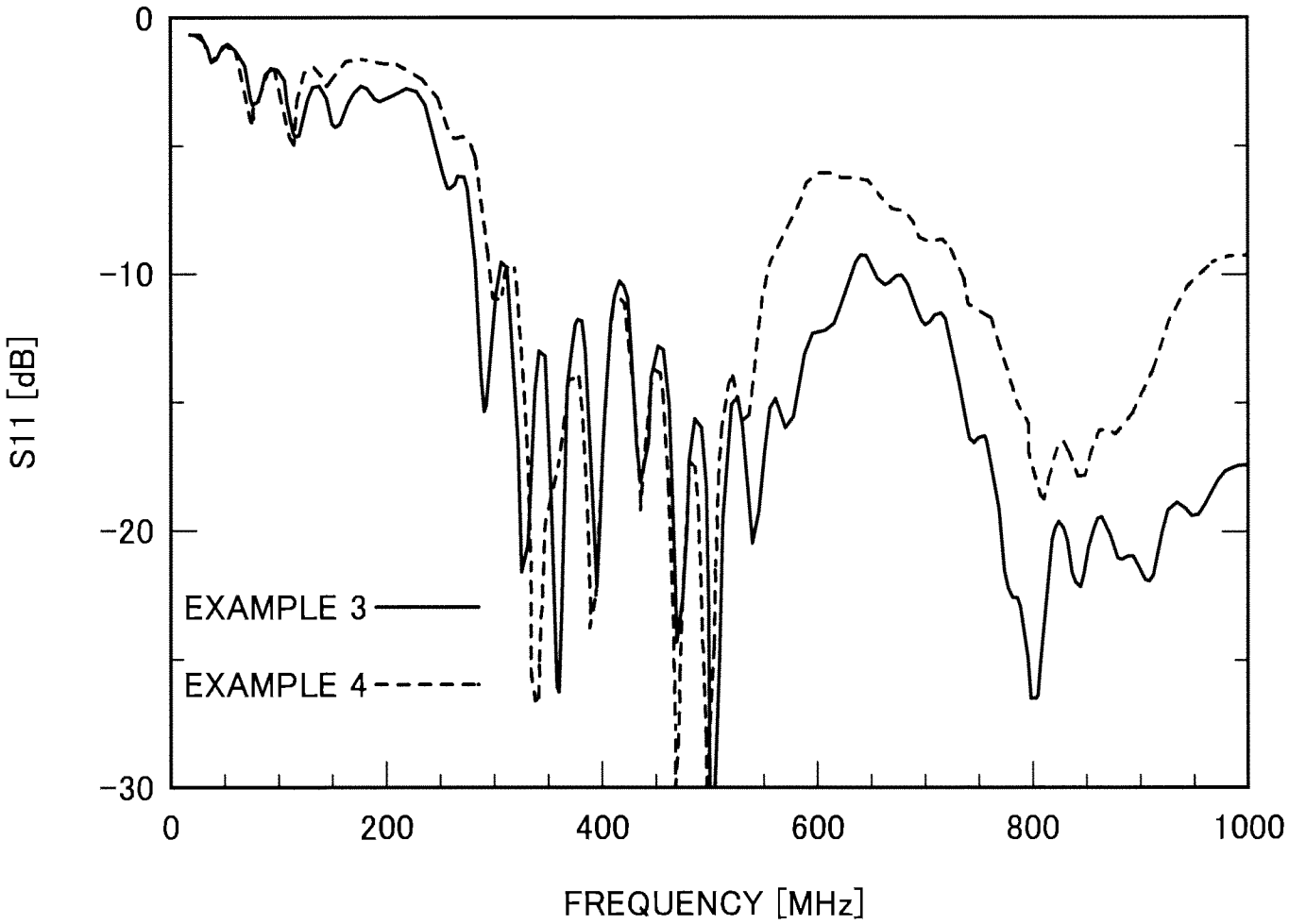
FIG. 8 a view illustrating simulation results of S11.

FIGS. 7 and 8 show simulation results of S11, respectively. For example 1, a result of an embodiment in FIG. 6A where "H2" is 125 mm and "W2" is 113.5 mm is shown. For example 2, a result of an embodiment in FIG. 6B where "H2" is 125 mm and "W2" and "W4" are 113.5 mm is shown. For example 3, a result of an embodiment in FIG. 6A where "H2" is 187.5 mm and "W2" is 176 mm is shown. FIG. 8 also shows a result of an embodiment in FIG. 6B (example 4) where "H2" is 187.5 mm and "W2" and "W4" are 176 mm.

As shown in FIGS. 7 and 8, according to the antenna apparatus of the embodiment, frequency bandwidth capable of resonating the antenna can be varied (it means that the antenna is matched) by adjusting the distance (W2, W4) of the notches from the electrode 16 or the length H2 of the notches. In other words, for the cases shown in FIG. 7, the resonance frequency bandwidth is 400 to 800 MHz. Then, as shown in FIG. 8, the resonance frequency bandwidth can be shifted to 300 to 600 MHz by elongating the distance (W2, W4) or the length H2 without changing the gap length H1 of the clearance 10*a*.

TABLE 1

| | 300 MHz | 400 MHz | 500 MHz | UNIT: [dB] 600 MHz |
|---|---|---|---|---|
| EXAMPLE 1 | 0.55 | 2.29 | 0.69 | 0.62 |
| EXAMPLE 2 | 1.22 | 3.15 | 1.80 | 1.78 |
| EXAMPLE 3 | 0.87 | 0.08 | 0.55 | 0.69 |
| EXAMPLE 4 | 1.49 | 0.63 | 1.89 | 4.03 |

Table 1 shows the difference of radiation efficiencies at the respective frequency shown in table 1 for each of the examples 1 to 4. The radiation efficiency is a benchmark of energy conversion efficiency between the antenna and the air.

There are many cases that the characteristics of the antenna depend on a degree of impedance matching in addition to the radiation efficiency. Thus, it is desirable to consider actual gain of the antenna when studying the characteristics in an actual environment. The actual gain is defined by a value obtained by subtracting radiation efficiency η (losses by the dielectric material and conductive material) and mismatching loss (loss originated from impedance mismatching) from directional gain Gd.

Thus, the actual gain is expressed as follows.

$$\text{Actual gain } Gw=(1-\Gamma^2)\times\text{radiation efficiency } \eta\times\text{directional gain } Gd$$

Here, β is reflection coefficient (linear expression of S11). It means that the actual gain includes influences of both the radiation efficiency and S11 (return-loss). Here, it is assumed that S11 (return-loss) is the same and the significance of the antenna characteristics is evaluated based on the difference of radiation efficiencies.

Each of the values expressing the difference of radiation efficiencies in table 1 is a relative value with respect to the radiation efficiency of the structure shown in FIG. 6A without the notch (only with the electrode 16). It means that each of the values is normalized so that the radiation efficiency of the structure shown in FIG. 6A without the notch 24 becomes 0 dB. Thus, when the value is plus, it means that the radiation efficiency is improved compared with the structure without the notch 24. As shown in table 1, by providing the notch, without changing the gap length H1 of the clearance 10*a*, the radiation efficiency is improved for the frequencies shown in table 1 compared with the case without the notch. Further, as can be understood from the comparison between the example 1 and the example 2, or between the example 3 and the example 4, the radiation efficiency can be further increased by increasing the number of notches. As the energy is radiated by the notch, the current that flows through the outer edge of the conductive film can be suppressed to improve the antenna gain.

As such, by providing the notch in the vicinity of the electrode, the antenna can be matched without changing the gap length of the clearance between the end portion of the flange of the vehicle body and the outer edge of the conductive film. As a result, as the antenna can be matched by adjusting the notch without changing the size of the conductive film, an area where the transmission of the heat waves cannot be suppressed can be prevented from becoming large. Further, the radiation efficiency can be increased so that the antenna gain can be easily improved.

The present invention may be preferably used for a vehicle antenna that receives, for example, digital terrestrial television broadcasting, analog television broadcasting of UHF band, digital television broadcasting of the USA, digital television broadcasting of European Union regions, or digital television broadcasting of China. In addition, the present invention may be used for FM broadcast band of Japan (76 to 90 MHz), FM broadcast band of the USA (88 to 108 MHz), television VHF band (90 to 108 MHz, 170 to 222 MHz) or a vehicle keyless entry system (300 to 450 MHz).

The present invention may also be used for an 800 MHz band mobile telephone system (810 to 960 MHz), an 1.5 GHz band mobile telephone system (1.429 to 1.501 GHz), a Global Positioning System (GPS: artificial satellite GPS signal 1575.42 MHz) or a Vehicle Information and Communication System (registered trademark) (VICS: 2.5 GHz).

Further, the present invention may also be used for communication of Electronic Toll Collection System (transmit frequency of roadside radio equipment: 5.795 GHz or 5.805 GHz, a received frequency of roadside radio equipment: 5.835 GHz or 5.845 GHz), Dedicated Short Range Communication (DSRC: 915 MHz band, 5.8 GHz band, 60 GHz band), microwave (1 GHz to 3 THz), millimeter wave (30 to 300 GHz) or Satellite Digital Audio Radio Service (SDARS: 2.34 GHz, 2.6 GHz).

Although a preferred embodiment of antenna apparatus has been specifically illustrated and described, it is to be understood that minor modifications may be made therein without departing from the spirit and scope of the invention as defined by the claims.

The present invention is not limited to the specifically disclosed embodiments, and numerous variations and modifications and modifications may be made without departing from the spirit and scope of the present invention.

What is claimed is:

1. An antenna apparatus comprising: a glass plate that is fixed to a flange of a vehicle body at a window opening portion of the vehicle body; a dielectric material; a conductive film provided between the glass plate and the dielectric material; and a monopolar feeding portion provided on the dielectric material at a surface opposite to a glass plate side and at a position capable of being capacitively coupled to the conductive film, the antenna apparatus being configured such that a clearance between an end portion of the flange of the vehicle body and an outer edge of the conductive film functions as a slot antenna, the conductive film being provided with a notch having one end as an open end at the outer edge of the conductive film in the vicinity of the monopolar feeding portion, the conductive film is positioned to overlap the monopolar feeding portion projected on the glass plate side, and the monopolar feeding portion is capacitively coupled to the conductive film.

2. The antenna apparatus according to claim 1, wherein the monopolar feeding portion is positioned between the outer edge of the conductive film at which the open end is provided and an interface line that is parallel to the outer edge and passes a front end portion, which is an end of the notch opposite to the open end, of the notch.

3. The antenna apparatus according to claim 1, wherein the conductive film is provided with a plurality of the notches, and the monopolar feeding portion is positioned between the plurality of notches.

4. The antenna apparatus according to claim 1, wherein a gap length of the clearance is less than or equal to 20 mm.

5. The antenna apparatus according to claim 1, wherein the dielectric material is another glass plate different from the glass plate.

6. The antenna apparatus according to claim 5, further comprising: an intermediate film provided between the glass plate and the other glass plate.

7. The antenna apparatus according to claim 6, wherein the intermediate film is provided:

between the glass plate and the conductive film;

between the other glass plate and the conductive film; or between the glass plate and the conductive film, and between the other glass plate and the conductive film.

8. The antenna apparatus according to claim 1, wherein the dielectric material is a plate or a film object.

* * * * *